US008693161B2

(12) United States Patent
Gefter et al.

(10) Patent No.: US 8,693,161 B2
(45) Date of Patent: Apr. 8, 2014

(54) IN-LINE CORONA-BASED GAS FLOW IONIZER

(71) Applicant: Illinois Tool Works Inc., Glenview, IL (US)

(72) Inventors: Peter Gefter, South San Francisco, CA (US); Leslie W. Partridge, San Jose, CA (US); Lyle Dwight Nelson, San Jose, CA (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 13/731,104

(22) Filed: Dec. 30, 2012

(65) Prior Publication Data

US 2013/0112892 A1 May 9, 2013

Related U.S. Application Data

(62) Division of application No. 12/925,360, filed on Oct. 20, 2010, now Pat. No. 8,416,552.

(51) Int. Cl.
*H01T 23/00* (2006.01)
*H05F 3/04* (2006.01)
*H05F 3/06* (2006.01)

(52) U.S. Cl.
USPC ..... 361/231; 361/213; 361/229; 361/235

(58) Field of Classification Search
USPC ..... 361/231, 213, 229, 235
See application file for complete search history.

(56) References Cited

U.S. PATENT DOCUMENTS

| | | | | | |
|---|---|---|---|---|---|
| 3,374,941 | A | | 3/1968 | Okress | 315/111.91 |
| 3,585,060 | A | | 6/1971 | Gourdine et al. | 427/460 |
| 3,764,804 | A | | 10/1973 | Hirschman | 250/49.5 |
| 3,768,258 | A | | 10/1973 | Smith et al. | 60/275 |
| 4,258,736 | A | | 3/1981 | Denbow | 137/2 |
| 4,734,105 | A | | 3/1988 | Eliasson et al. | 95/62 |
| 4,757,422 | A | * | 7/1988 | Bossard et al. | 361/231 |
| 4,810,342 | A | * | 3/1989 | Inoue | 204/192.17 |
| 4,812,711 | A | | 3/1989 | Torok et al. | 315/111.91 |
| 4,872,083 | A | * | 10/1989 | Blitshteyn | 361/213 |
| 4,976,752 | A | | 12/1990 | Torok et al. | 96/43 |
| 5,116,583 | A | | 5/1992 | Batchelder et al. | 422/186.07 |

(Continued)

FOREIGN PATENT DOCUMENTS

| | | | |
|---|---|---|---|
| EP | 1 610 429 A2 | 12/2005 | |
| JP | 2004273293 | 9/2004 | H01T 19/04 |

(Continued)

OTHER PUBLICATIONS

Automated JPO/INPIT translation of JP 2007 048682 9 pages.

(Continued)

*Primary Examiner* — Stephen W Jackson
*Assistant Examiner* — Zeev V Kitov
(74) *Attorney, Agent, or Firm* — The Patent Source

(57) ABSTRACT

Self-balancing, corona discharge for the stable production of electrically balanced and ultra-clean ionized gas streams is disclosed. This result is achieved by promoting the electronic conversion of free electrons into negative ions without adding oxygen or another electronegative gas to the gas stream. The invention may be used with electronegative and/or electropositive or noble gas streams and may include the use of a closed loop corona discharge control system.

23 Claims, 12 Drawing Sheets

(56) References Cited

U.S. PATENT DOCUMENTS

| | | | | |
|---|---|---|---|---|
| 5,138,348 | A * | 8/1992 | Hosaka et al. | 347/128 |
| 5,296,018 | A | 3/1994 | Suzuki | 95/65 |
| 5,447,763 | A | 9/1995 | Gehlke | 428/34.1 |
| 5,550,703 | A | 8/1996 | Beyer et al. | 361/229 |
| 5,650,203 | A | 7/1997 | Gehlke | 428/34.1 |
| 5,688,308 | A * | 11/1997 | Voigts | 96/18 |
| 5,847,917 | A | 12/1998 | Suzuki | 361/213 |
| 6,161,311 | A * | 12/2000 | Doley et al. | 34/548 |
| 6,373,680 | B1 | 4/2002 | Riskin | 361/231 |
| 6,528,023 | B2 * | 3/2003 | Fleischer | 422/186.04 |
| 6,563,110 | B1 | 5/2003 | Leri | 250/282 |
| 6,566,887 | B2 | 5/2003 | Smith et al. | 324/514 |
| 6,636,411 | B1 | 10/2003 | Noll | 361/213 |
| 6,646,856 | B2 | 11/2003 | Lee et al. | 361/232 |
| 6,693,788 | B1 | 2/2004 | Partridge | 361/231 |
| 6,736,133 | B2 * | 5/2004 | Bachinski et al. | 126/521 |
| 6,807,044 | B1 | 10/2004 | Vernitsky et al. | 361/230 |
| 6,850,403 | B1 | 2/2005 | Gefter et al. | 361/230 |
| 6,919,053 | B2 * | 7/2005 | Joannou | 422/186 |
| 7,051,419 | B2 | 5/2006 | Schrom et al. | 29/854 |
| 7,120,007 | B2 | 10/2006 | Nakasone et al. | 361/231 |
| 7,180,722 | B2 * | 2/2007 | Jacobs et al. | 361/231 |
| 7,208,030 | B2 | 4/2007 | Totoki | 96/19 |
| 7,212,393 | B2 | 5/2007 | Gefter et al. | 361/230 |
| 7,258,715 | B2 * | 8/2007 | Cox et al. | 55/422 |
| 7,356,987 | B2 | 4/2008 | Kiser et al. | 60/278 |
| 7,365,316 | B2 | 4/2008 | Miller et al. | 250/288 |
| 7,375,944 | B2 | 5/2008 | Izaki et al. | 361/230 |
| 7,697,258 | B2 | 4/2010 | Vernitskiy et al. | 361/230 |
| 7,813,102 | B2 | 10/2010 | Gefter et al. | 361/213 |
| 2004/0045442 | A1 | 3/2004 | Ziya Ramizovich et al. | 96/94 |
| 2005/0236375 | A1 | 10/2005 | Gefter et al. | 219/121.36 |
| 2006/0187609 | A1 | 8/2006 | Dunn | 361/230 |
| 2006/0193100 | A1 | 8/2006 | Izaki et al. | 361/220 |
| 2006/0260928 | A1 | 11/2006 | Avnery et al. | 204/157.3 |
| 2006/0285269 | A1 | 12/2006 | Ohtsuka et al. | 361/225 |
| 2007/0006478 | A1 | 1/2007 | Kotsuji | 34/96 |
| 2007/0025771 | A1 | 2/2007 | Robles Flores et al. | 399/172 |
| 2007/0158578 | A1 | 7/2007 | Vernitskiy et al. | 250/423 R |
| 2007/0181820 | A1 | 8/2007 | Hwang et al. | 250/396 R |
| 2008/0078291 | A1 | 4/2008 | Daukant | 95/69 |
| 2008/0130190 | A1 | 6/2008 | Shimada | 361/231 |
| 2008/0225460 | A1 | 9/2008 | Gefter et al. | 361/213 |
| 2008/0232021 | A1 | 9/2008 | Gefter et al. | 361/213 |
| 2009/0050801 | A1 | 2/2009 | Fedorov | 250/288 |
| 2009/0219663 | A1 | 9/2009 | Sato et al. | 361/220 |
| 2010/0044581 | A1 | 2/2010 | Fujita et al. | 250/424 |
| 2010/0128408 | A1 | 5/2010 | Takayanagi | 361/213 |

FOREIGN PATENT DOCUMENTS

| | | | |
|---|---|---|---|
| JP | 2004362951 | 12/2004 | H01T 19/04 |
| JP | 2006236763 | 9/2006 | 3/4 |
| JP | 2007048682 | 2/2007 | 3/4 |

OTHER PUBLICATIONS

Automated JPO/INPIT translation of JP 2006 236763 10 pages.
PCT Application PCT/US01/01215, Notification of Transmittal of the International Search Report . . . and associated International Search Report, mailed Jul. 9, 2010; 3 pages total.
PCT Application PCT/US01/01215, Written Opinion of the International Searching Authority, mailed Jul. 9, 2010; 7 pages total.
United Filtration System Inc., disposable in-line filter datasheets including the DIF-MN50 filter, 6 pages on 6 sheets, Jan. 31, 2006.
Freescale Semiconductor, Inc. datasheet (Rev 0) for MPXV6115 Series including data for MPXV6115VC6U Integrated Pressure Sensor, 8 pages on 8 sheets, 2009.
Atmel Corporation datasheet for 8-bit AVR with 8K Bytes In-System Programmable Flash including data for ATMEGA8 microcontroller, 22 pages on 11 sheets, 2003.
Fox Valve Development Corp. Bulletin 401 A including data for Fox Mini-Eductors, 10 pages on 10 sheets, Nov. 21, 2002.
Anver Corporation catalog, Section 3 (Air Powered Vacuum Generators & Accessories) including datas for ANVER JV-09 Series Mini Vacuum Generator, 88 pages, date unknown.
Automated JPO/1NPIT translation of JP 2004-273293 A 28 pages.
Automated JPO/1NPIT translation of JP 2004-362951 A 29 pages.
PCT Application PCT/US2010/053741, Notification of Transmittal of the International Search Report . . . and associated International Search Report, mailed Dec. 22, 2010; 4 pages total.
PCT Application PCT/US2010/053741, Written Opinion of the International Searching Authority, mailed Dec. 22, 2010; 9 pages total.
PCT Application PCT/US2010/053996, Notification of Transmittal of the International Search Report . . . and associated International Search Report, mailed Dec. 23, 2010; 4 pages total.
PCT Application PCT/US2010/053996, Written Opinion of the International Searching Authority, mailed Dec. 23, 2010; 7 pages total.
PCT Application PCT/US2011/024010, Notification of Transmittal of the International Search Report . . . and associated International Search Report, mailed April 6, 2011; 4 pages total.
PCT Application PCT/US2011/024010, Written Opinion of the International Searching Authority, mailed Apr. 6, 2011; 10 pages total.
EU Patent Application—10825741.1-1801/2491770 PCT/US2010053741—Communication (Including European Search Report), mailed Jun. 24, 2013; 6 pages total.
SG Patent Application—201202934-4—Written Opinion, mailed Oct. 31, 2013; 8 pages total.

* cited by examiner

IN-LINE CORONA-BASED GAS FLOW IONIZER

CROSS REFERENCE TO RELATED CASES

This divisional application claims the benefit under 35 U.S.C. §120 of copending U.S. Patent Application, Ser. No. 12/925,360 filed Oct. 20, 2010 and entitled " Self-Balancing Ionized Gas Streams ", which application is hereby incorporated by reference in its entirety and which application claimed the benefit under 35 U.S.C. 119 (e) of the following applications: U.S. Application Ser. No. 61/279,610 filed Oct. 23, 2009 and entitled "Self-Balancing Ionized Gas Streams ".

BACKGROUND OF THE INVENTION

1. Field of the Invention

The invention relates to the field of static charge neutralization apparatus using corona discharge for gas ion generation. More specifically, the invention is directed to producing electrically self-balanced, bipolar ionized gas flows for charge neutralization. Accordingly, the general objects of the invention are to provide novel systems, methods, apparatus and software of such character.

2. Description of the Related Art

Processes and operations in clean environments are specifically inclined to create and accumulate electrostatic charges on all electrically isolated surfaces. These charges generate undesirable electrical fields, which attract atmospheric aerosols to the surfaces, produce electrical stress in dielectrics, induce currents in semi-conductive and conductive materials, and initiate electrical discharges and EMI in the production environment.

The most efficient way to mediate these electrostatic hazards is to supply ionized gas flows to the charged surfaces. Gas ionization of this type permits effective compensation or neutralization of undesirable charges and, consequently, diminishes contamination, electrical fields, and EMI effects associated with them. One conventional method of producing gas ionization is known as corona discharge. Corona-based ionizers, (see, for example, published patent applications US 20070006478, JP 2007048682) are desirable in that they may be energy and ionization efficient in a small space. However, one known drawback of such corona discharge apparatus is that the high voltage ionizing electrodes/emitters (in the form of sharp points or thin wires) used therein generate undesirable contaminants along with the desired gas ions. Corona discharge may also stimulate the formation of tiny droplets of water vapor, for example, in the ambient air.

Another known drawback of conventional corona discharge apparatus is that the high voltage ionizing electrodes/emitters used therein tend to generate unequal numbers of positive and negative gas ions instead of roughly equal concentrations of positive and negative ions as is desired in most applications. This problem is especially acute in applications requiring the ionization of electropositive gases (such as nitrogen and argon) because high purity electropositive and noble gases have high ionization energy and low electronegativity. For example, the ionization energy of electronegative $O_2$ is 12.2 eV, compared to 15.6 eV for $N_2$, and 15.8 eV for Argon. As a result, these gases tend to produce large numbers of free electrons rather than negative ions. Restated, although these gases do produce three types of charge carriers (electrons, positive ions, and negative ions) they primarily produce positive polarity ions and electrons. Thus, negative ion emission is relatively rare and the production of positive ions and of negative ions is far from equal/balanced.

Furthermore, ion imbalance may also arise from the fact that ion generation rate and balance are dependent on a number of other factors such as the condition of the ionizing electrode, gas temperature, gas flow composition, etc. For example, it is known in the art that corona discharge gradually erodes both positive and negative ion electrodes and produces contaminant particles from these electrodes. However, positive electrodes usually erode at faster rate than negative electrodes and this exacerbates ion imbalance and ion current instability.

Conventional practice for balancing ion flow is to use a floating (electrically isolated from ground) high voltage DC power supply. The high voltage output of such a power supply is connected to positive and negative electrodes (as shown and described in U.S. Pat. No. 7,042,694). This approach, however, requires using at least two ion electrodes with high voltage isolation between them.

An alternative conventional method of balancing ion flow is to use two (positive and negative) isolated DC/pulse DC voltage power supplies and to adjust the voltage output and/or the voltage duration applied to one or two ion electrodes (as shown and described in published US Applications 2007/0279829 and 2009/0219663). This solution has its own drawbacks. A first drawback is the complexity resulting from the need to control each of the high voltage power supplies. A second drawback is the difficulty of achieving a good mix of positive and negative ions in the gas flow from two separate sources.

The aforementioned problems of emitter erosion and particle generation in conventional ionizers are particularly challenging for corona ionization of high purity nitrogen, argon, and noble gases. Positive polarity corona discharge in these gases generates positive cluster ions having low mobility (low energy) at normal atmospheric conditions. However, negative polarity corona discharge generates high energy electrons as a result of non-elastic collision between electrons and neutral molecules due to field emission from the emitter and photo-ionization in the plasma region around the electrode tip. These free electrons in electropositive and noble gases have a low probability of attachment to neutral gas atoms or molecules. Further, free electrons have more than 100 times higher electrical mobility than gas-borne negative ions. Consequences of these facts include:

- high energy electron bombardment of the electrode surface accelerates erosion which, in turn, produces particles that contaminate the ionized gas flow;
- high mobility electrons create significant imbalance in the ionized gas flow; and
- free electrons are able to produce secondary electron emission, initiate corona current instability and/or cause breakdown.

One prior art solution to the above-mentioned problems is employed in the MKS/Ion Systems, Nitrogen In-line ionizer model 4210 (u/un). FIG. 1 presents a simplified structure of this apparatus. As shown therein, the ionizing cell (IC) of this device has positive and negative emitters (PE) and (NE) spaced far apart, with gas 3 flowing between them. Each emitter is connected to a floating output of high voltage DC power supply (DC-PS) via current-limiting resistors (CLR1) and (CLR2). In this design, as with others of this general type, positive emitter erosion is a source of contaminant particles and ion imbalance. Also, the efficiency of any system that ionizes a gas stream passing between two electrodes is limited.

Another approach to the same problem is disclosed in U.S. Pat. No. 6,636,411 which suggests introducing a certain percentage of electron-attaching gas (such as oxygen) into the plasma region to convert (attach) free electrons into negative ions and stabilize corona discharge. However, the introduction of oxygen (or some other electronegative gas) precludes use of this approach in clean and ultra-clean environments and/or anywhere non-oxidizing gas streams are required.

SUMMARY OF THE INVENTION

The present invention overcomes the aforementioned and other deficiencies of the prior art by providing self-balancing corona discharge for the stable production of an electrically balanced stream of ionized gas. The invention achieves this result by promoting the electronic conversion of free electrons into negative ions without adding oxygen or another electronegative gas (or doping) to the ionized gas stream. The invention may be used with any one or more of electronegative gas streams, noble gas streams electropositive gas streams and/or any combination of these gas streams and may include the use of a closed loop control system.

In accordance with the present invention and as disclosed herein, there are two distinct regions within the corona discharge region (i.e., within the region of an ionization cell between ionizing electrode(s) and a non-ionizing reference electrode):

(a) a glowing plasma region which is a small (about 1 mm in diameter) and generally spherical region, centered at or near the ion emitter tip(s) where an ionizing electrical field provides sufficient energy to generate new electrons and photons to, thereby, sustain the corona discharge; and (b) an ion drift region which is dark space between the glowing plasma region and the non-ionizing reference electrode.

According to the invention an alternating ionizing signal, of cycle T having positive and negative portions, is applied to an ionizing electrode to produce charge carriers, in a non-ionized gas stream that defines a downstream direction, to thereby form an ionized gas stream. The charge carriers comprising clouds of electrons, positive ions, and negative ions. Advantageously, the electrons of the electron cloud produced during a portion Tnc of the negative portion of the ionizing signal is induced to oscillate in the ion drift region. This electron cloud oscillation increases the probability of elastic collision/attachment between oscillating electrons and neutral molecules in a stream of gas (for example, high purity nitrogen). Since free electrons and neutral molecules are converted into negative ions when such elastic collision/attachment occurs, use of the invention increases the number of negative ions in the ionized gas stream.

Optionally providing a dielectric barrier (i.e. electrical isolation) between at least one reference electrode and the ion drift region further promotes conversion of a high number of electrons into lower mobility negative ions. This effect provides stable corona discharge, helps to balance the number of positive and negative ions, and improves harvesting of positive and negative ions by the gas stream flowing through the ionizer.

Certain optional embodiments of the invention use a two-fold approach to balance the ion flow in an ionized gas stream: (1) capacitively coupling the ionizing corona electrode(s) to a radio frequency (RF) high voltage power supply (HVPS), and (2) electrically isolating the reference electrode from the ionized gas stream (for example, by insulating the reference electrode(s) from the gas stream with a dielectric material).

Certain optional embodiments of the invention also envisions the use of a control system (which is able to work in electropositive as well as in electronegative gases) in which increasing voltage pulses are repeatedly applied to an ionizing electrode until corona discharge occurs to, thereby, determine the corona threshold voltage for the electrode. The control system may then reduce the operating voltage to a quiescent level that is generally equal to the corona threshold voltage to minimize corona currents, emitter erosion and particle generation. In this way, certain embodiments of the invention may protect ionizing electrodes from damage (such as erosion) by RF corona currents in electropositive and noble gases. Embodiments of the invention that use such a control system may, therefore, not only better balance the ionized gas stream, they may automatically and optimally balance the ionized gas stream (i.e., these embodiments may be self-balancing).

Naturally, the above-described methods of the invention are particularly well adapted for use with the above-described apparatus of the invention. Similarly, the apparatus of the invention are well suited to perform the inventive methods described above.

Numerous other advantages and features of the present invention will become apparent to those of ordinary skill in the art from the following detailed description of the preferred embodiments, from the claims and from the accompanying drawings.

BRIEF DESCRIPTION OF THE DRAWINGS

The preferred embodiments of the present invention will be described below with reference to the accompanying drawings where like numerals represent like steps and/or structures and wherein.

DETAILED DESCRIPTION OF THE PREFERRED EMBODIMENTS

Figure 1:
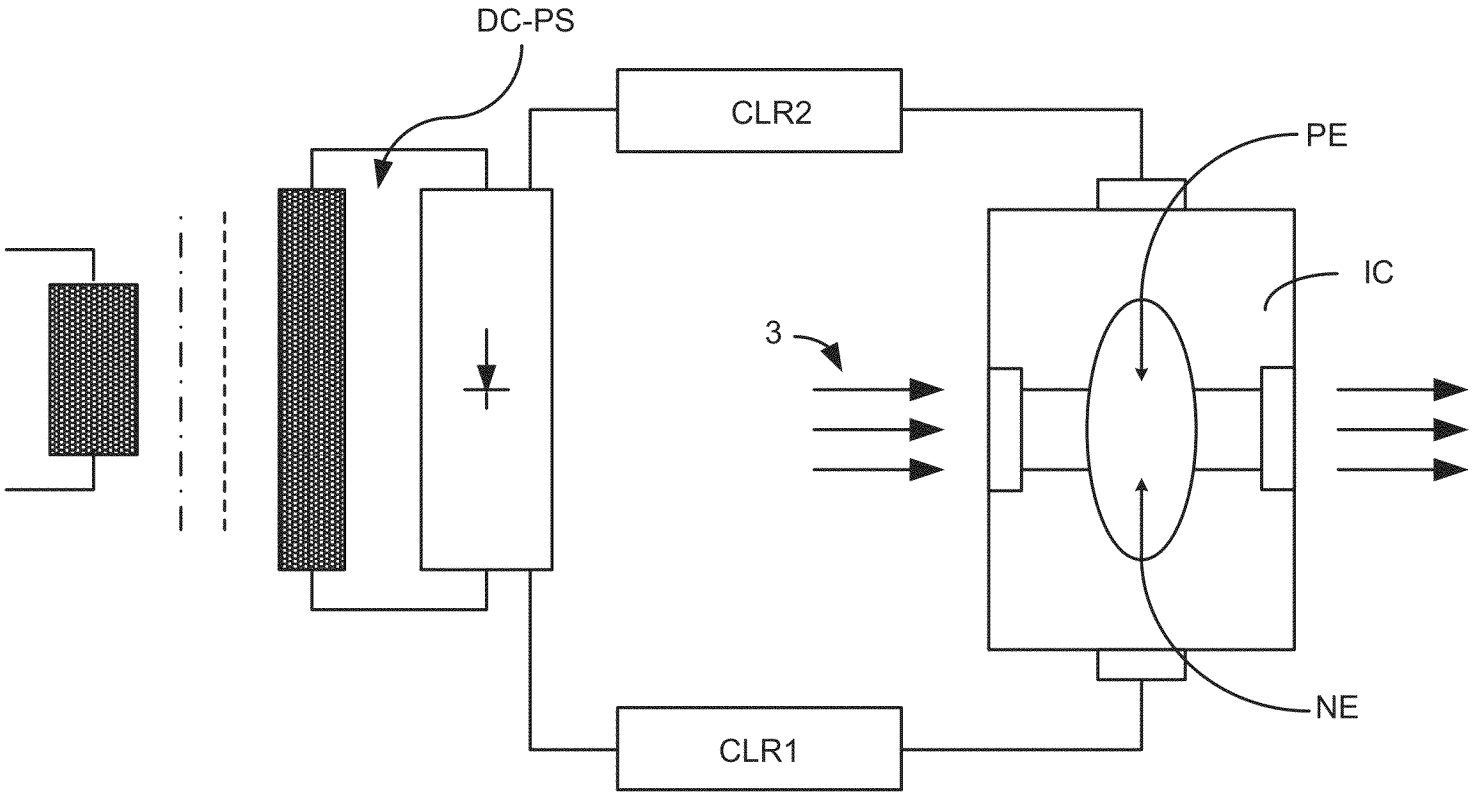
Figure 1 PRIOR ART
FIG. 1 is a prior art nitrogen gas in-line ionizing apparatus.
Figure 2:
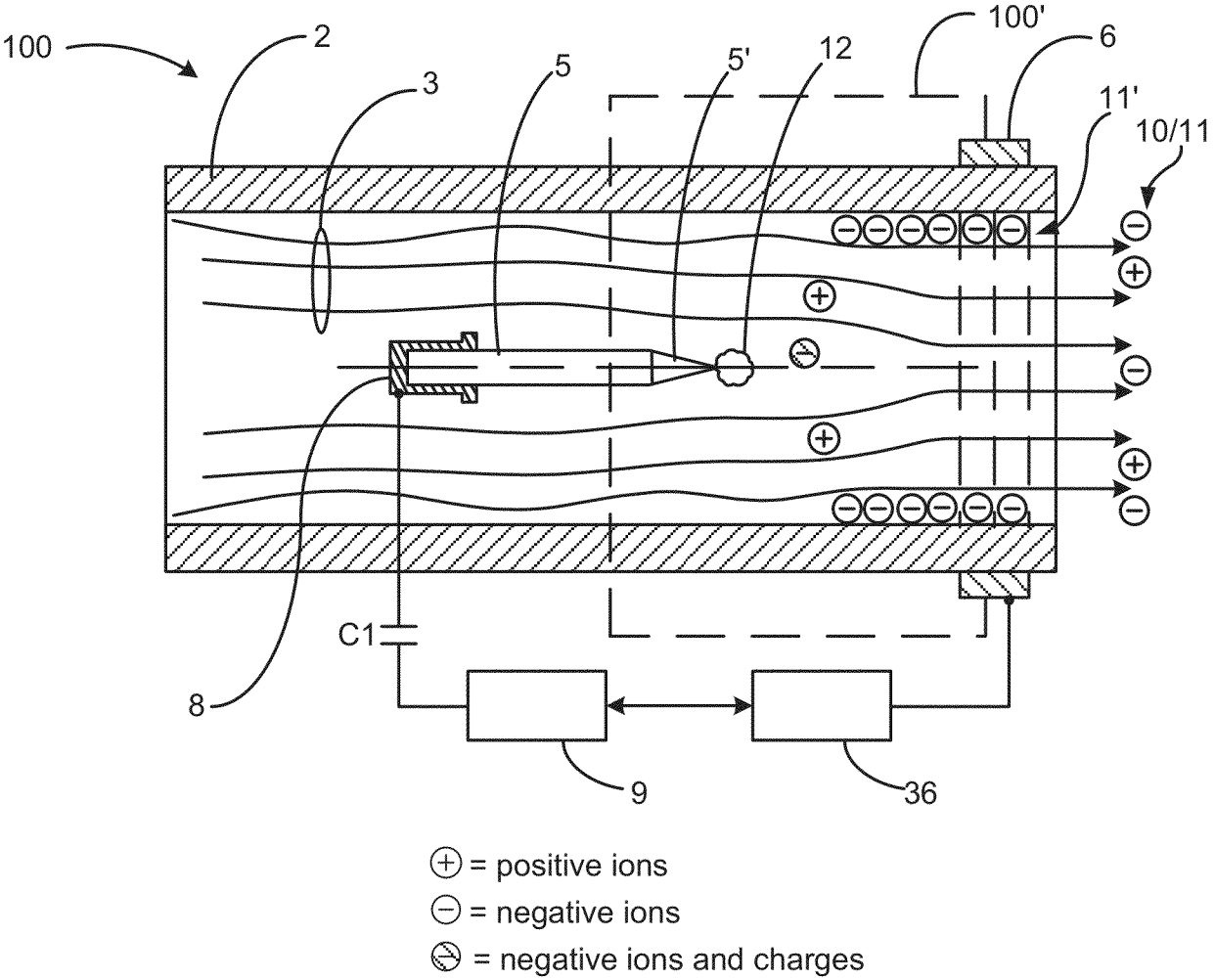
FIG. 2 is a schematic representation of an ionization cell in accordance with one preferred embodiment of the invention.

FIG. 2 is a schematic representation illustrating preferred methods and apparatus for creating an ionized gas stream 10/11 (using, for example, electronegative/electropositive/noble gases) with at least substantially electrically-balanced concentrations of charge carriers over a wide range of gas flow rates. This goal is accomplished through an ionization cell 100' that includes an insulated reference electrode 6 and an ionizing electrode 5 capacitively-coupled to a high voltage power supply (HVPS) 9 preferably operating in the radio frequency range.

As shown in FIG. 2, the preferred inventive ionizer 100 comprises at least one emitter (ionizing corona electrode) 5 located inside a through-channel 2 that accommodates the gas flow 3 that defines a downstream direction. The electrode 5 can be made from conductive material such as tungsten, metal based alloys, coposits (ceramics/metal) or semi-conductive material such as silicon and/or may be made of any material and/or have any structure described in the incorporated applications. The electrode 5 may be stamped, cut from wire machined or made in accordance with other techniques known in the art.

The ion-emitting end of the electrode 5 may have a tapered tip 5' with small radius of about 70-80 microns. The opposite tail end of the electrode may be fixed in a socket 8 and may be connected to high voltage capacitor C1 which may be connected to the output of high voltage AC power supply 9 of the type described throughout. In this preferred embodiment, the power supply 9 is preferably a generator of variable magnitude AC voltage that may range from about 1 kV to about 20 kV (10 kV preferred) and at a frequency that may range from about 50 Hz to about 200 kHz (with 38 kHz being most preferred).

Figure 4:
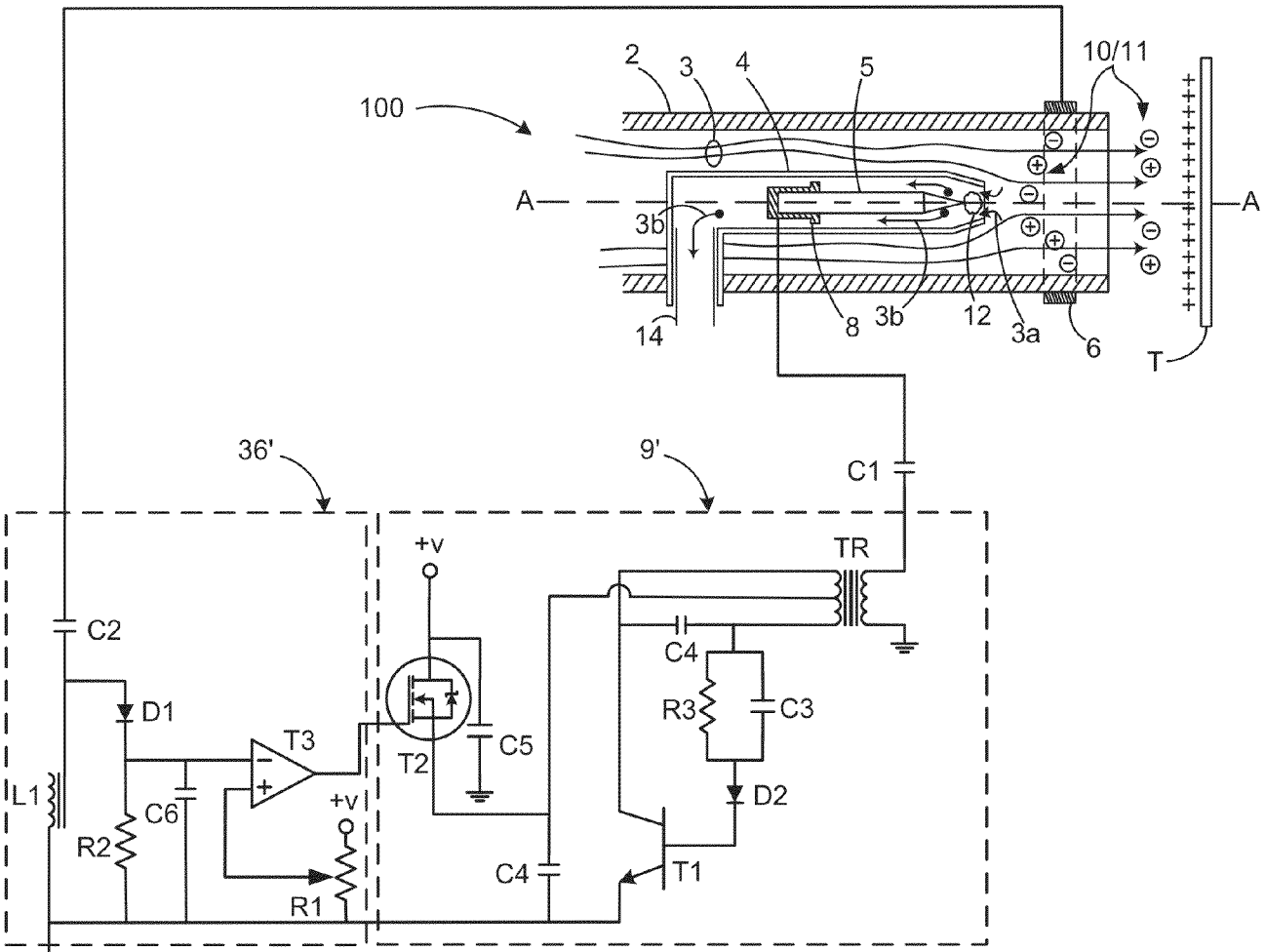
FIG. 4 is a schematic representation of a gas ionizing apparatus with an RF HVPS using an analog control system in accordance with self-balancing embodiments of the present invention.

A non-conductive shell with an orifice near the tip of the electrode and an evacuation port for removing corona byproducts could be placed around the electrode (see shell 4 shown in FIG. 4). The optional shell may be stamped, machined or made in accordance with other techniques known in the art. The details of such an arrangement have been disclosed in the above-referenced and incorporated patent applications.

The through channel 2 may be made from a dielectric material and may be stamped, machined or made in accordance with other techniques known in the art. A source of high-pressure gas (not shown) may be connected to inlet of the through-channel 2 to establish a stream 3 of clean gas, such as electropositive gases including nitrogen. A reference electrode 6 is preferably in form of conductive ring. The reference electrode 6 is preferably insulated from inner space of the channel 2 by relatively thick (1-3 mm) dielectric wall and electrically coupled to a control system 36.

The electrode 5 and reference electrode 6 form the main components of the ionization cell 100' where corona discharge may take place. Gas ionization starts when the voltage output of power supply 9 exceeds the corona onset voltage $V_{CO}$. Corona quench (suppression) usually takes place at lower voltages. The effect is known as corona hysteresis and it is more substantial at high frequencies in electropositive gases.

As known in the art, corona onset voltage values and volt-ampere characteristics for positive and negative polarity discharges are different. That is one of the reasons the corona discharge generates unequal amount of positive and negative charge carriers in the gas. As a result, ion flow leaving a corona emitter is unbalanced in conventional systems. In accordance with this preferred embodiment, however, this imbalance is corrected as described herein. As shown, electrode 5 may be communicatively coupled via capacitor C1 to power supply 9 to achieve two goals: first, to limit the ion current flowing from electrode 5 and, second, to equalize amount positive and negative charge carriers 10/11/11' leaving the electrode 5. Capacitively coupling the power supply 9 to emitter 5 balances the charge carriers 10/11/11' from the emitter because, according to the law of charge conservation, unequal positive and negative currents accumulate charges and generate voltages on capacitor C1 balancing positive and negative currents from the electrode 5. The preferred capacitance value of capacitor C1 depends on the operating frequency of the HVPS 9 with which it is capacitively coupled. For a preferred HVPS with an operating frequency of about 38 kHz, the optimum value of C1 is preferably in the range of about 20 picoFarads to about 30 picoFarads. Although balancing positive ions and electrons from the electrode in this way is a notable advance over the related art, the preferred embodiment of FIG. 2 further envisions improvements that facilitate the conversion of free electrons of an electron cloud into negative ions in the drift region (between the ionizing electrode and the downstream reference electrode) as discussed immediately below.

According to Ohm's law, the current density J [A/m$^2$] created by the charge carriers movement is:

$$J=q\times N\times E\times\mu$$

where q is an ion or electron charge; N is the concentration of charge carriers, μ is the electrical mobility of charge carriers, and E is the field intensity in the drift zone.

It is known in art that the mean mobility of positive gas ions is (+)μ=1.36 $10^{-4}$m$^2$ V$^{-1}$ s$^1$, for negative ions it is (−)μ=1.53 $10^{-4}$ m$^2$ V$^{-1}$ s$^{-1}$ and for electrons it is (−)μ=200 $10^{-4}$ m$^2$ V$^{-1}$ (or higher depending on type of gas, pressure, temperature, etc.). As a consequence, equal concentrations of (+) N ions and (−) N electrons moving in the drift zone of the ionization cell 10 may create very different magnitudes of currents (+) J and (−) J and highly unbalanced gas flows.

To solve the imbalance problem in the drift zone, the invention facilitates the conversion of electrons into lower mobility negative ions. The conversion rate is influenced by the duration of electron generation, dimensions of the ionization cell, the frequency and magnitude of the voltage applied to the electrode(s) 5 and material properties of the ionization cell 10. The operating frequency (F) of the HVPS ranges from about 50 Hz to about 200 kHz and a radio frequency range of about 10 kHz to about 100 kHz is preferred. A high voltage amplitude should be close to the negative corona threshold $(-)V_{CO}$. These factors are discussed in detail below.

Figure 3A:
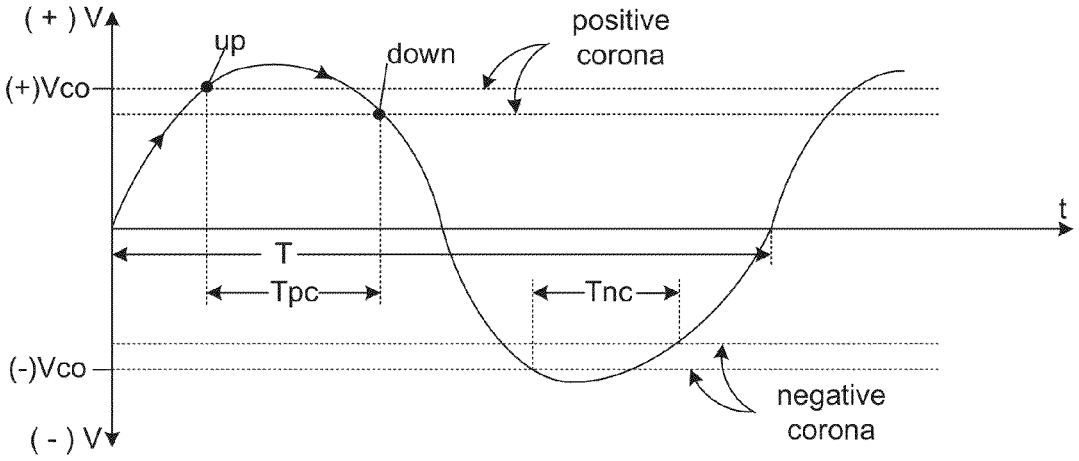
FIG. 3*a* shows a voltage waveform applied to an ionizing electrode operating in accordance with the preferred embodiment of FIG. 2.
Figure 3B:
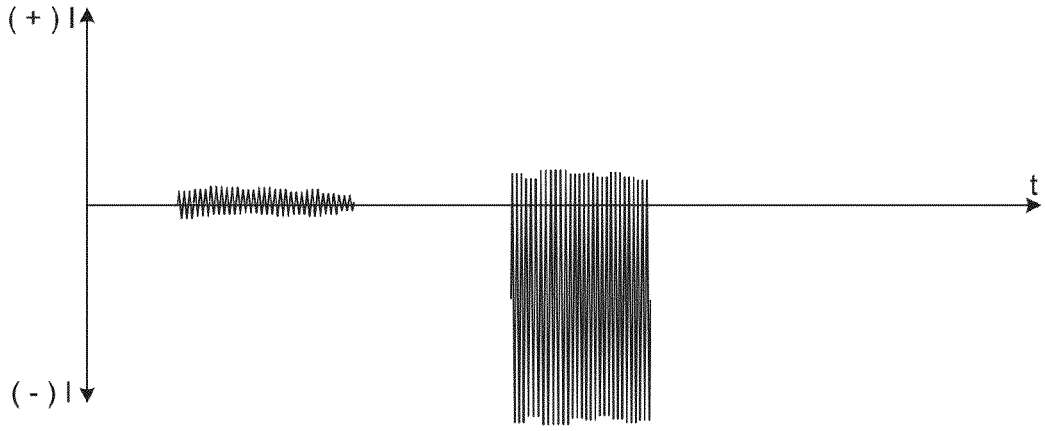
FIG. 3*b* shows a corona current waveform discharged from an ionizing electrode operating in accordance with the preferred embodiment of FIGS. 2 and 3*a;*
Figure 3C:
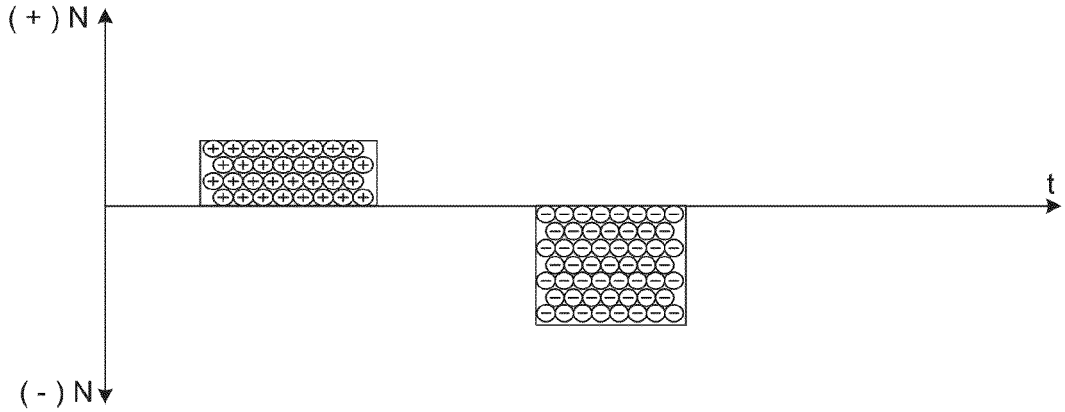
FIG. 3*c* shows positive and negative charge carrier generation from an emitter operating in accordance with the preferred embodiment of FIGS. 2, 3*a* and 3*b;*

FIG. 3*a* shows one preferred waveform used in the embodiment of FIG. 2 and this may be generated by high voltage power supply 9. In the preferred most frequency of about 38 kHz, negative charge carriers are generated only during a very short period of time $T_{nc}$ during negative part of the voltage cycle. As a result, $T_{nc}$ is typically equal to or less one tenth of the voltage cycle. At the same time, it would take time $T_e$ for the electron clouds to move from the electrode 5 to the reference electrode 6:

$$T_e=L/U=L/(E_d\times(-)\mu),$$

where: U is velocity of electrons; μ is the mobility of electrons; $E_d$ is the average field strength in the drift zone; and L is an effective length of the drift zone.

If an electron cloud travel time $T_e$ is equal or less than the duration (time period) of electron generation by negative corona ($T_e \leq T_{nc}$) most of the electrons emitted during that cycle will not have sufficient time to escape the ion drift zone. As discussed below, these electrons will be drawn back toward the emitter during the subsequent/opposite half cycle of the waveform from the HVPS 9.

It will further be appreciated that the electrical field of the emitter and the electron space charge in the drift region cause some of the electrons 11' to deposit on the inner walls of channel 2 in the drift region, as shown in FIG. 2. These negative charges 11' create an additional repulsion force decreasing velocity of electrons moving to the reference electrode. This effect further reduces the ability of the free electrons to escape the ion drift region.

Another way this preferred embodiment decreases the velocity of the free electrons is to employ a dielectric material with a long time constant as the wall of the through-channel 2. That time constant τ is preferably ≥100 seconds (or charge relaxation time $\tau=R\times\in$, where R is resistance and ∈ is dielectric constant of the channel material). Suitable materials include polycarbonate and Teflon because they have time constant equal to or greater than 100 seconds. PC Polycarbonate made by Quadrant EPP USA, Inc. of 2120 Fairmont Ave., P.O. Box 1235 Reading, Pa. 19612 and (PTEF) Teflon Style 800, made by W. L. Gore & Associates Inc., 201 Airport Road P.O. Box 1488, Elkton, Md. 21922 are presently believed to be the most advantageous wall materials.

During the positive part of the cycle, the positive voltage creates an attractive force for the electron cloud. That is why if both preferable conditions are met: $T_e<0.1\text{-}0.2/F$ and $\tau>100$ s, each high voltage cycle produces oscillation of electron clouds inside the drift region.

The oscillating electron cloud results in a higher probability of elastic collision/attachment of electrons to the neutral gas molecules in the drift region and conversion of a large portion of free electrons to negative gas ions 11. Negative nitrogen ions have mobility close to average mobility airborne negative ions $(-)\mu=1.5\ 10^{-4}\ m^2\ V^{-1}\ s^{-1}$ This is notably lower than the mobility of free electrons in a nitrogen stream which is known to be at least 100 times larger.

This electron conversion to negative ions improves corona discharge stability due to the elimination of streamers and lowered probability of breakdown and leads to substantially equal concentrations of positive and negative ions 10/11 in the ionized gas stream.

Low mobility positive and negative ions 11 can be easily harvested (collected and moved) by the gas flow. Gas flow at 601/min creates linear velocity movement of about 67 meters per second (m/s) in the ion drift region. Negative and positive ions have linear velocity about 35 m/s in an electrical field of about 2.3 $10^5$ volts per meter (V/m) (compared with a mean electron velocity of about 4,600 m/s in the same field). So, in high frequency/RF fields, electrons 11' move primarily in response to the electrical field, while positive and negative ions 10/11 move primarily by diffusion and gas stream velocity in the drift region.

For protection of the ion emitter from damage by high frequency corona discharge, an optional feature of a preferred embodiment of the invention provides for limiting the current from the electrode(s) 5. This is achieved by continuously using the reference electrode (as a means for monitoring) to feedback a monitor signal (that is responsive of the charge carriers within the ionized gas stream) to a control system to adjust the RF power supply 9 so that the voltage applied to electrode 5 remains at or near the corona threshold voltage.

In accordance with the preferred embodiment shown in FIG. 4, HVPS 9' includes an adjustable self-oscillating generator built around a high voltage transformer TR. In particular, FIG. 4 represents a preferred embodiment in which a reference electrode 6 is capacitively coupled to an analog control system 36' via capacitor C2. As shown, the ring electrode 6 is isolated from ionized gas flow 3 by the insulating dielectric channel 2; thus, blocking the conductive current from the ionized gas.

A high pass filter L1/C2 with a cutoff frequency of about 1 MHz is used to feedback the corona signal from reference electrode 6. This filtered corona signal may be rectified by diode D1, filtered via low pass filter R2/C6, delivered to voltage-comparator T3/R1 (wherein R1 presents a predetermined comparator voltage level) and then delivered to the gate of an n-channel power MOSFET transistor T2. Transistor T2, in turn, supplies sufficient current to drive the power oscillator/high voltage transformer circuit 9'. Other signal processing may include high gain amplification, integration to reduce the noise component, and comparison with a reference corona signal level. The signal processing noted above greatly reduces the noise inherent in the corona signal and this may be especially important in conjunction with certain preferred embodiments because high voltage power supply 9' preferably operates in the radio frequency range.

In use, when ionization starts, corona discharge and the corona signal (taken from reference electrode 6 and reflecting the displacement current) are high since the feedback signal has just started. The corona signal remains high (typically for a few milliseconds) until the feedback circuit starts to adjust to this condition. The control circuit quickly reduces the high voltage applied to the ionizer to a lower level as determined by a predetermined reference voltage and, preferably, keeps the corona discharge constant at this level. By monitoring the corona feedback (of the communicatively coupled reference electrode) and modulating the high voltage drive, the control system 36' and the HVPS 9' have the ability to keep the operating voltage at or near the corona threshold and minimize emitter damage.

Figure 5A:
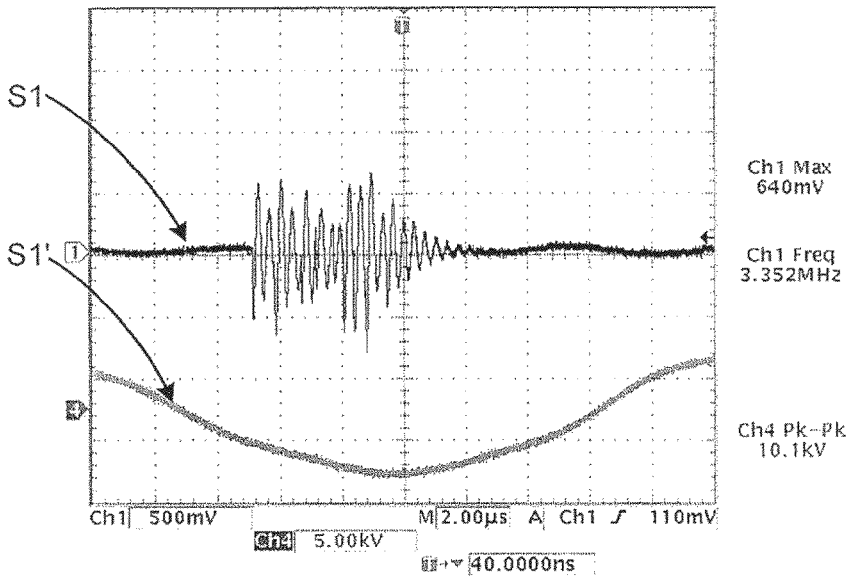
FIG. 5*a* is an oscilloscope screen-shot comparing a representative high voltage signal applied to an ion emitter and a representative corona induced displacement current in air in accordance with the invention.

Those of skill in the art will note that capacitor C2 of FIG. 4 is charged by a displacement current which has two main components: (1) an induced signal from the high voltage field of the emitter and having basic frequency F (preferably about 38 kHz), and (2) a signal generated by the corona discharges itself. Representative oscilloscope screen-shots illustrating these components are shown in FIGS. 5*a* (S1' and S1) and 5*b* (S2' and S2). The recorded waveforms shown therein present both signals in the same time frame. As shown, the corona signal generated on the reference electrode in air 51 (see FIG. 5*a*) is different from the corona signal generated on the reference electrode in nitrogen S2 (see FIGS. 5*b* and 5*c*). In most cases, corona discharge in air creates two initial transient spikes of oscillating discharge (See signal 51 of FIG. 5*a*). This is possibly related to the different ionization energies of oxygen (one substantial component of air) and nitrogen.

Figure 5B:
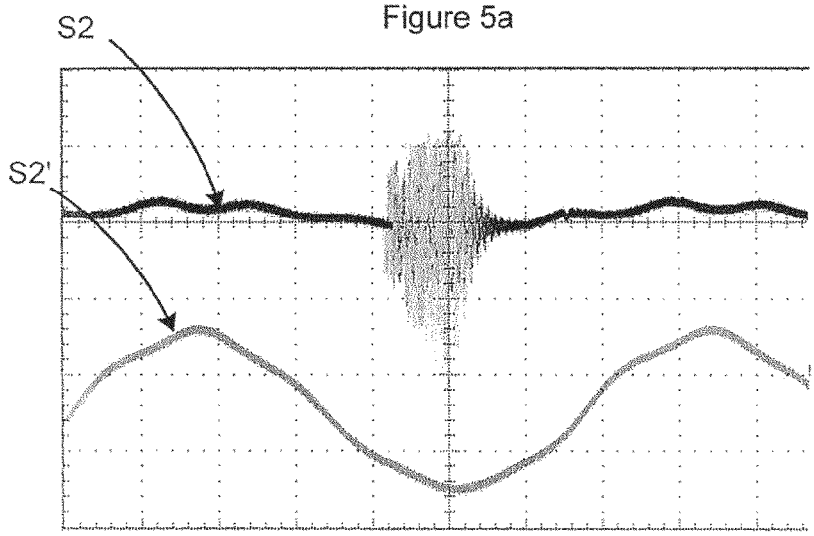
FIG. 5*b* is an oscilloscope screen-shot comparing a representative high voltage signal applied to an ion emitter and a representative corona induced displacement current in nitrogen.
Figure 5C:
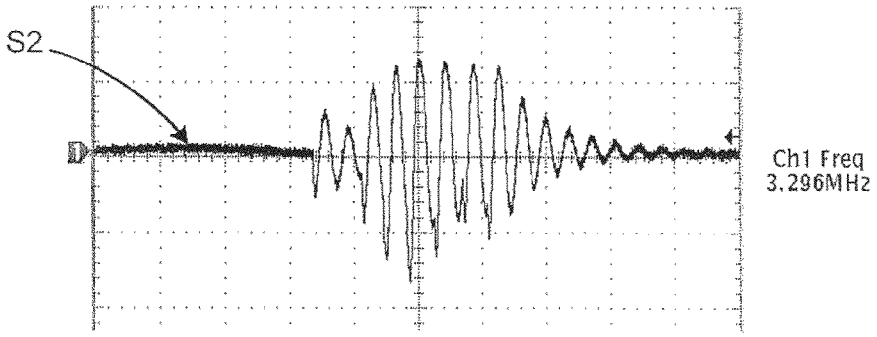
FIG. 5*c* is an oscilloscope screen-shot of the corona-induced current signal of FIG. 5*b* in which the horizontal (time) axis has been expanded to show the applied voltage signal in greater detail.

FIGS. 5*b* and 5*c* show negative corona induced current S2 in clean nitrogen where the oscillating corona discharge signal S2 has one maximum (at the maximum ionizing voltage S2' applied to the electrode). Negative corona displacement current is much higher than positive current in both nitrogen and air. At high frequencies (such as 40-50 kHz), the range of movement of positive ions under the influence of an electrical field is limited. In particular, during the positive part of the high voltage cycle, positive ions 10 will only be able to move a fraction of one millimeter from the plasma region 12. Therefore, the movement of the positive ion cloud is controlled by relatively slow processes—diffusion and movement of the gas stream. As a result the reference electrode 6 will only be influenced by movement of the positive ions 10 by a negligible amount.

Figure 6A:
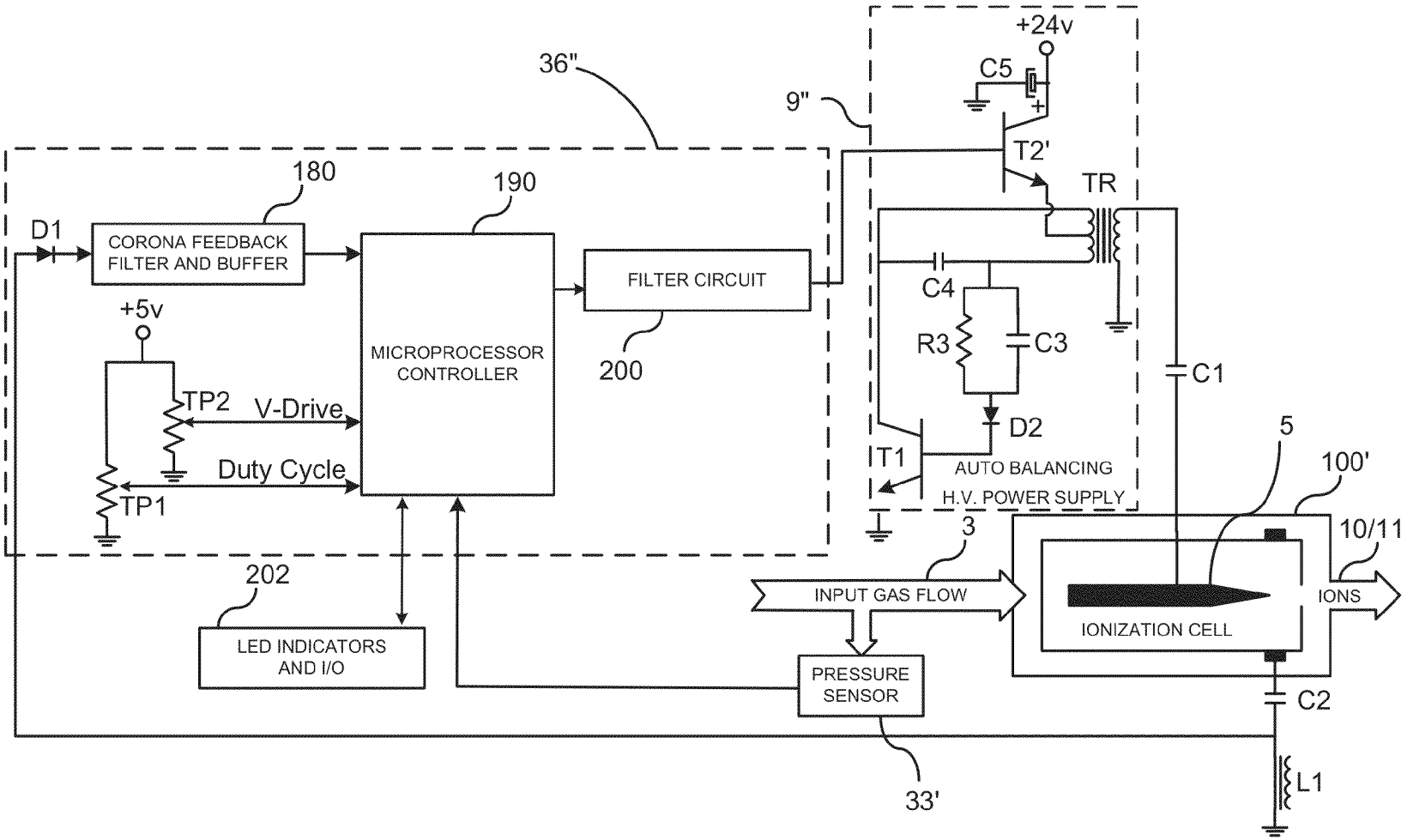
FIG. 6*a* is a schematic representation of a gas ionization apparatus with a HVPS and a microprocessor-based control system in accordance with self-balancing preferred embodiments of the invention.
Figure 6B:
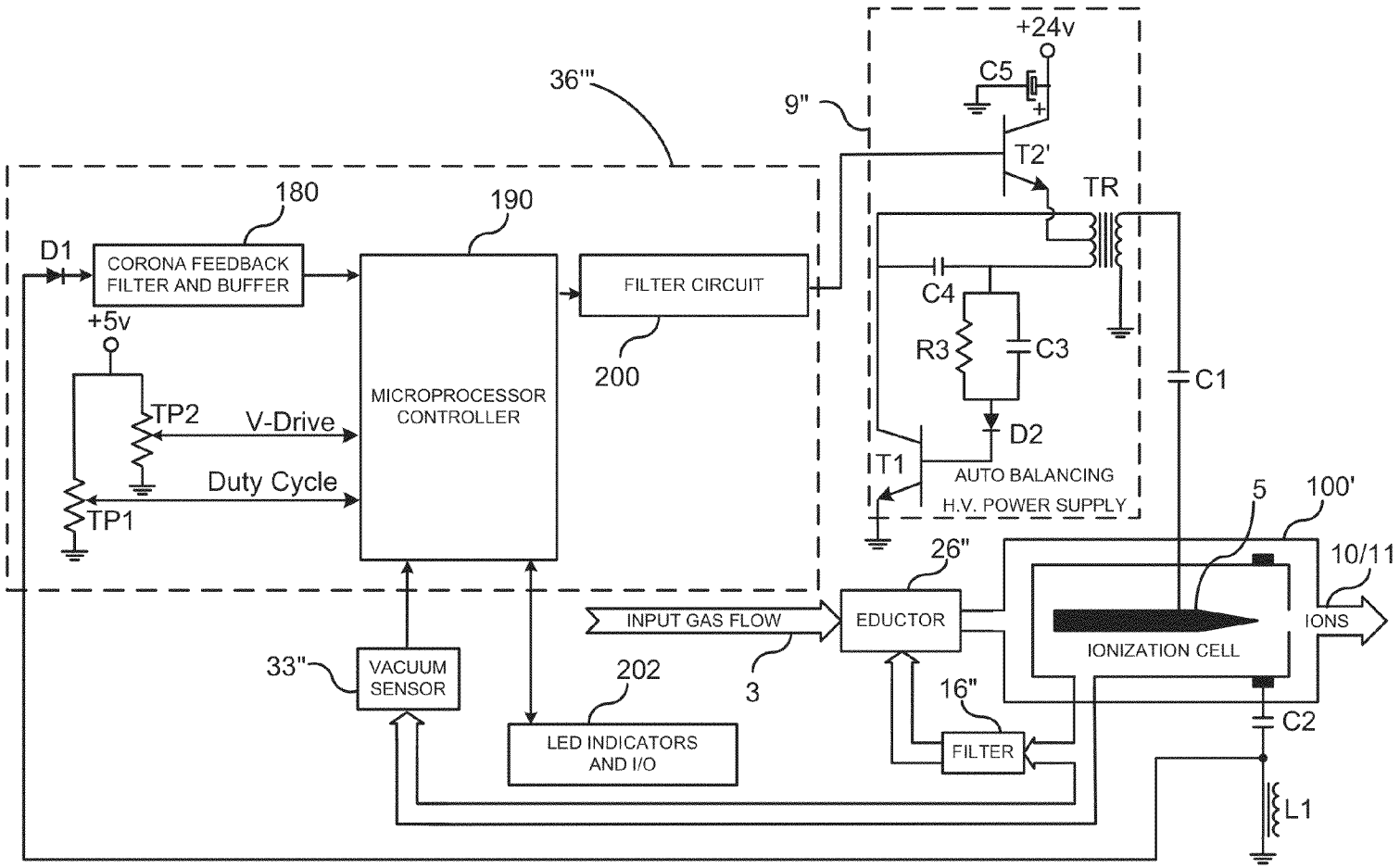
FIG. 6*b* is a schematic representation of another gas ionizing apparatus with an HVPS and a microprocessor-based control system in accordance with self-balancing preferred embodiments of the present invention.

Turning now to FIGS. 6*a* and 6*b*, there is shown therein schematic representations of two alternative gas ionizing apparatus, each having a HVPS 9" communicatively coupled to a microprocessor-based control system 36" and 36'" in accordance with two self-balancing preferred embodiments of the present invention.

In both of the embodiments of FIGS. 6*a* and 6*b*, the primary task of the microprocessor (controller) 190 is to provide closed loop servo control over the high voltage power supply 9" which drives the ionizing electrode 5. The preferred microprocessor is model ATMEGA 8 μP, made by Atmel, Orchard Pkwy, San Jose, Calif. 95131. The preferred transformer used herein is the transformer model CH-990702 made by CHIRK Industry Co., Ltd., with a current address of No. 10, Alley 22, Lane 964, Yung An Road, Taoyuan 330 Taiwan (www.chirkindustry.com). As shown in FIGS. 6*a* and 6*b*, the corona displacement current monitor signal from the reference electrode 6 may be filtered and buffered by filter 180 and supplied to an analog input of the microprocessor 190. The microprocessor 190 may compare the corona signal to a predetermined reference level (see TP2) and then generate a PWM (pulse width modulated) pulse train output voltage. The pulse train output voltage is then filtered and processed by filter circuit 200 to develop a drive voltage for the adjustable self-oscillating high voltage power supply 9" (similar to the alternative HVPS design 9' shown in FIG. 4).

To minimize corona discharge related damage and particle generation from ionizing electrode 5, the microprocessor 190 can supply the transformer TR of the high voltage power supply with pulses having different duty factors in the range of about 1-100%, and is preferably about 5-100% (see TP1). The pulse repetition rate can be set in the range of about 0.1-200 Hz, and is preferably about 30-100 Hz. Whereas microprocessor 190 may also be responsive to a pressure sensor 33' (see FIG. 6*a*), microprocessor 190 may (alternatively be responsive to a vacuum sensor 33" in other embodiments (see FIG. 6*b*).

Figure 9:
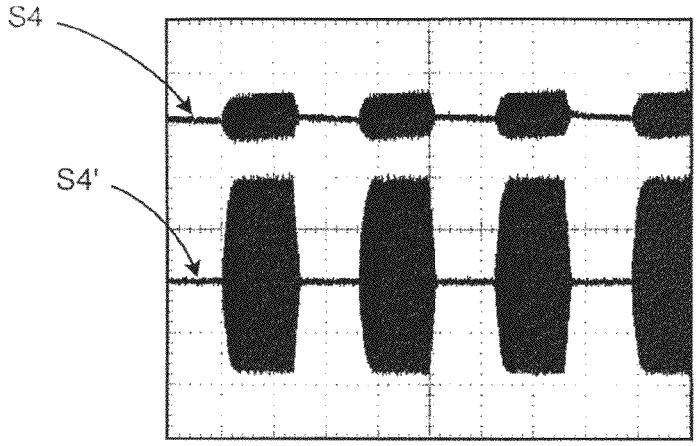
FIG. 9 is an oscilloscope screen-shot comparing a representative corona displacement current signal S4 (see the upper line on the screen) with a RF high voltage waveform S4' with a basic frequency of 45 kHz, a duty factor is about 49%, and a pulse repetition rate is 99 Hz.

At high gas flow rates (for example, 90-150 liters per minute) the time during which recombination of positive and negative ions may occur is short and the ion current from ionizer is high. In this case, the duty factor of the high voltage applied to the emitter can be lower (for example, 50% or less). FIG. 9 shows an example of high voltage waveform S4' supplied to the emitter 5 (basic frequency is preferably about 38 kHz, the duty factor is preferably about 49% and the pulse repetition rate is preferably about 99 Hz). It will be appreciated that the lower the duty factor, the shorter the time electrons/ions may bombard the emitter 5, and the less emitter erosion will occur (thereby extending the life of the emitter).

Adjustment of the duty factor may be made manually, using trim pot TP1 (duty cycle) connected to analog input of microprocessor, or automatically based on the measurement of the gas pressure or gas flow as measured by an appropriate gas sensor 33' (for example, a TSI Series 4000 High Performance Linear OEM Mass Flowmeter made by TSI Incorporated, 500 Cardigan Road, Shoreview, Minn. 55126) (see FIG. 6*a*).

The drive voltage is automatically established by the microprocessor 190 based on the feedback signal. Using trim pot TP2, the automatically determined drive voltage may be modified higher or lower if desired.

With such an arrangement the microprocessor-based control system may be used to take various actions in response to a signal from sensor(s) 33'. For example, the control system may shut down the high voltage power supply 9" if the flow level is below a predetermined threshold level. At the same time the microprocessor 190 may trigger an alarm signal "Low gas flow" (alarm/LED display system 202).

In the embodiment of FIG. 6*b*, when an eductor 26" is used to provide suction in the ionization shell, as described in the incorporated patent applications and as shown in FIG. 6*b*, a vacuum pressure from gas flow 3 inside the channel 2 can be used to detect the flow rate. In this case, a vacuum sensor 33" monitoring vacuum level in the evacuation port also provides information about the gas flow to the microprocessor 190. The microprocessor 190 is able to automatically adjust the drive voltage to the high voltage power supply 9" to keep ion current within specifications at different gas flow rates. The eductor used in this preferred embodiment of the invention may be an ANVER JV-09 Series Mini Vacuum Generator manufactured and marketed by the Anver Corporation located at 36 Parmenter Road, Hudson, Mass. 01749 USA; a Fox Mini-Eductor manufactured and marketed by the Fox Valve Development Corp. located at Hamilton Business Park, Dover, N.J. 07801 USA; or any equivalent thereof known in the art.

In typical industrial applications, ionizers often operate in high voltage "On-Off" mode. After a long "Off-cycle" time (generally more than one hour) the ionizer should initiate corona discharge in each "On-cycle". The corona startup process in electropositive gases (like nitrogen) usually requires higher initial onset voltage and current than may be required after an ionizer has been "conditioned". To overcome this problem the inventive ionizer may be run by a microprocessor-based control system in distinct modes: the "standby", "power on", "start up", "learning" and "operating" modes.

FIGS. 7*a*, 7*b*, 7*c*, 7*d* and 7*e* show functional flow charts of some preferred ionizer embodiments of the invention. In particular, these Figures show processes the microprocessor uses to (1) initiate corona discharge (7*a*—Power On Mode), (2) conditioning the ionizing electrode for corona discharge (7*b*—StartUp Mode), learn and fine tune the ionizing signal required to maintain corona discharge (7*e*—Learn Mode) and, then, (3) modulate the ionizing signal to maintain a desired corona discharge level (7*c*—Normal Operation Mode). Under various conditions described herein, the microprocessor may also enter a Standby Mode (7*d*). After Power On, process control transfers to one of the Standby or the Startup routines. Failure to successfully Startup will return control to the Power On routine. The loop may repeat (for example up to 30 times) before a high voltage alarm condition is set as indicated, for example, by a visual display such as constant illumination of a red LED. If the ionizer starts successfully, as determined, for example, by an acceptable corona feedback signal, control transfers to the Learn and the Normal Operation routines.

Figure 7A:
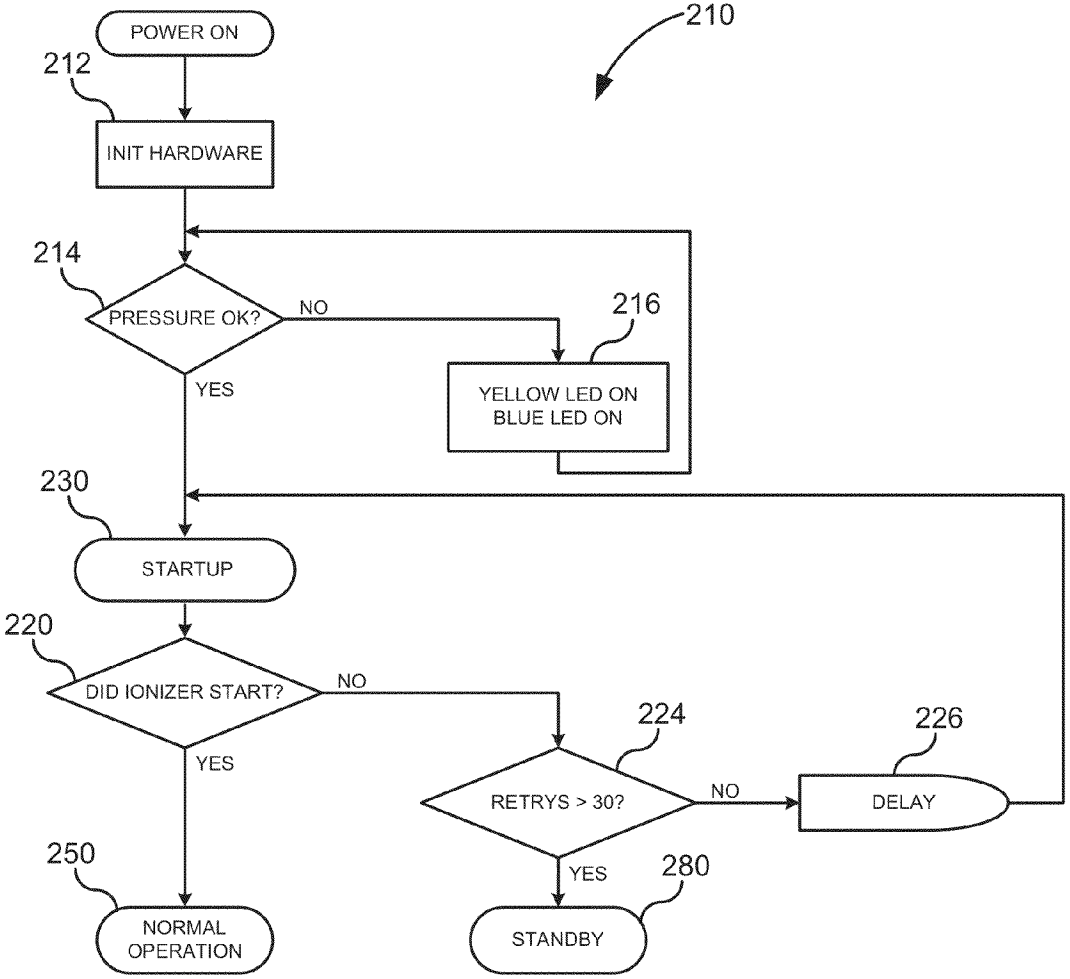
FIG. 7*a* is a flowchart illustrating a representative "Power On" mode of operating a control system in accordance with some preferred embodiments of the invention.
Figure 7B:
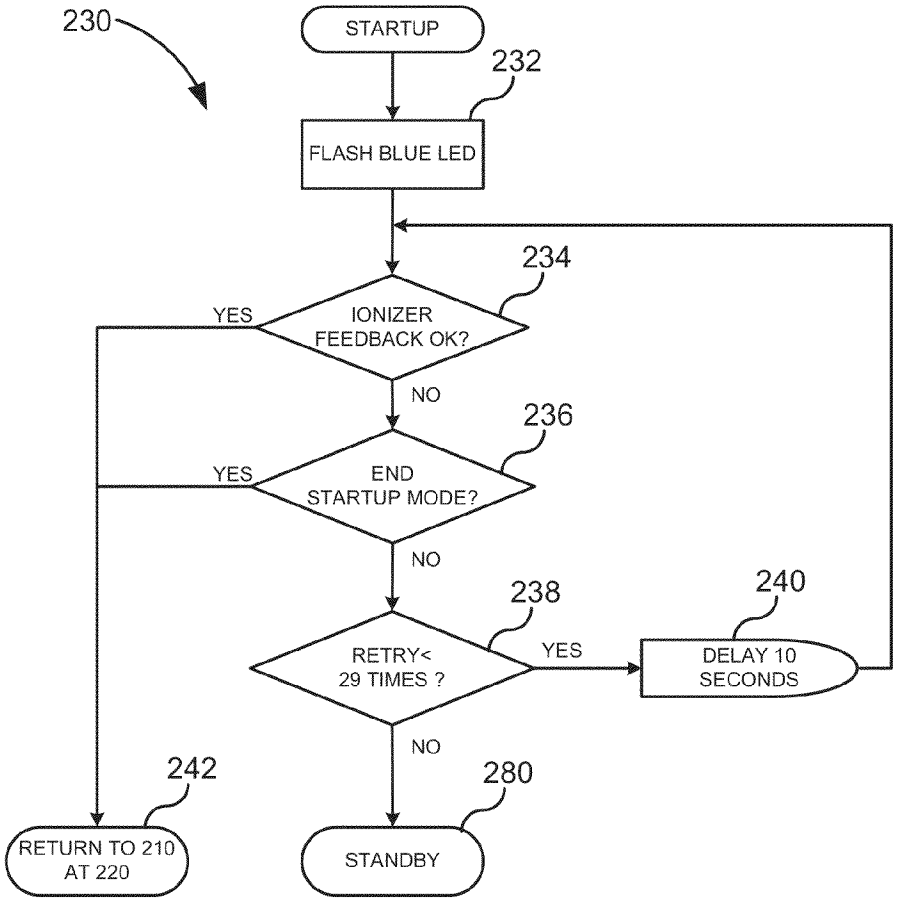
FIG. 7*b* is a flowchart illustrating a representative "Start-up" mode of operating a control system in accordance with some preferred embodiments of the invention.

Turning with emphasis on FIG. 7*a*, the power on mode 210 commences as the process passes to box 212 where the microprocessor sets its outputs to a proper, known state. The process then passes to decision box 214 where it is determined whether the gas flow pressure, indicated at the appropriate analog input, is sufficient to continue. If not, process passes to box 216 where yellow and blue indicator LED's are illuminated and the process passes back to decision box 214. When the pressure is sufficient to proceed, process 210 passes to box 230 which represents the start up routine of FIG. 7*b*.

Start up routine 230 begins at box 232 with the illumination of a flashing blue LED and passes to box 234 where a high voltage is applied to the ionizer until sufficient corona feedback signal exists on a preset voltage level. If so, the process passes to box 242 where the process returns to power on routine 210 of FIG. 7*a*. Otherwise, process 230 passes to decision box 236 where it will return to power on mode 210 if the start up mode 230 has ended. Otherwise, the process determines, at box 238, whether less than twenty-nine retries have occurred. If so, the process passes through box 240 and returns to box 234. If not, process 230 passes to the standby mode 280 shown in FIG. 7*d*.

Figure 7C:
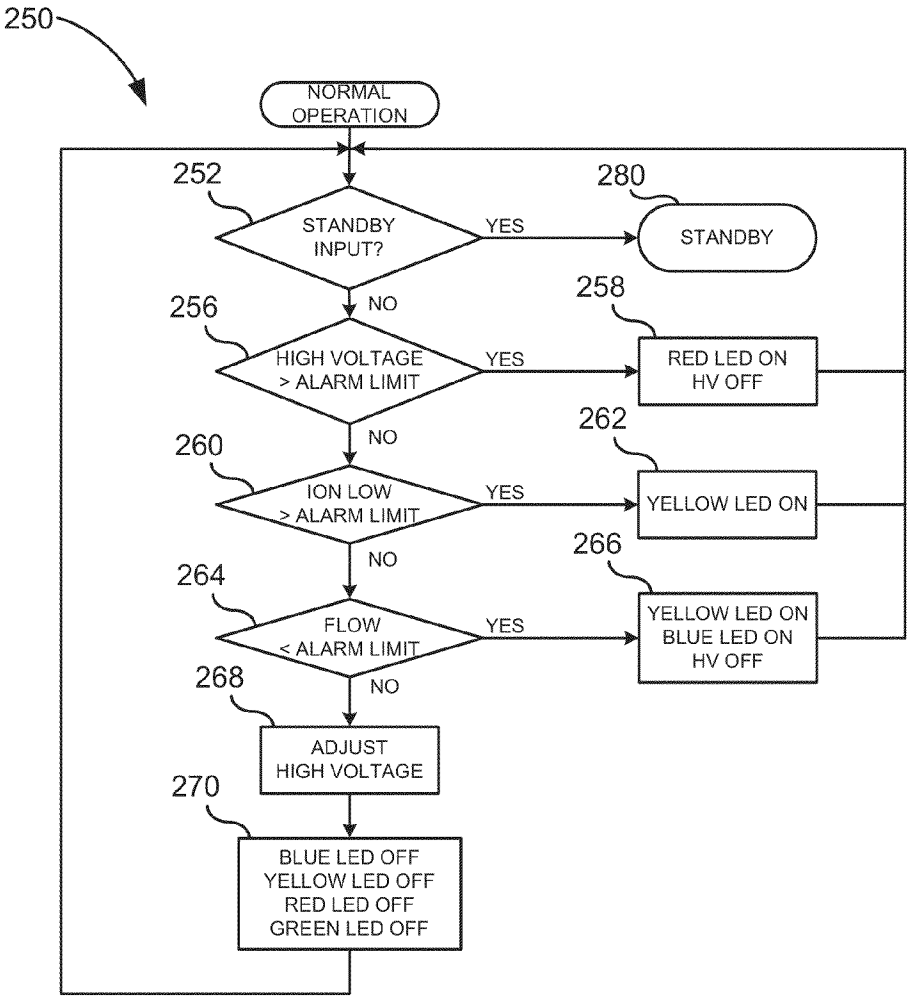
FIG. 7*c* is a flowchart illustrating a representative "Normal Operation mode control system operation of a gas ionizing apparatus in accordance with the some preferred embodiments of the invention.
Figure 7E:
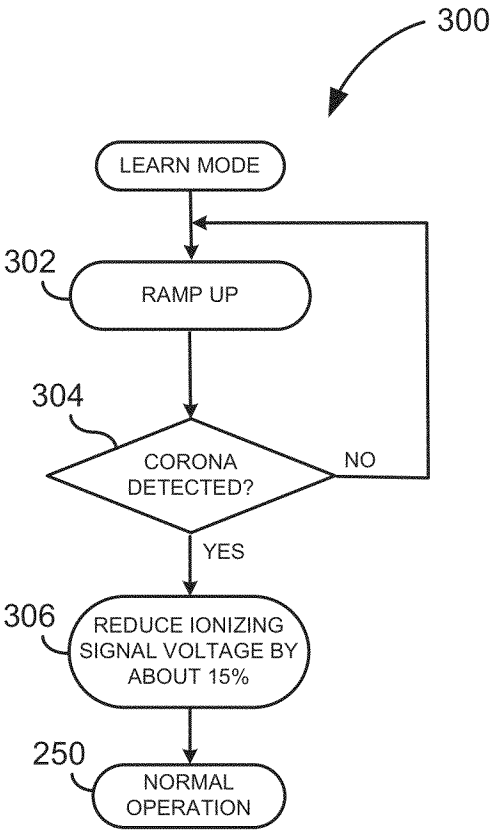
FIG. 7*e* is a flowchart illustrating a representative "Learn" mode of operating a control system in accordance with some preferred embodiments of the invention.
Figure 7D:
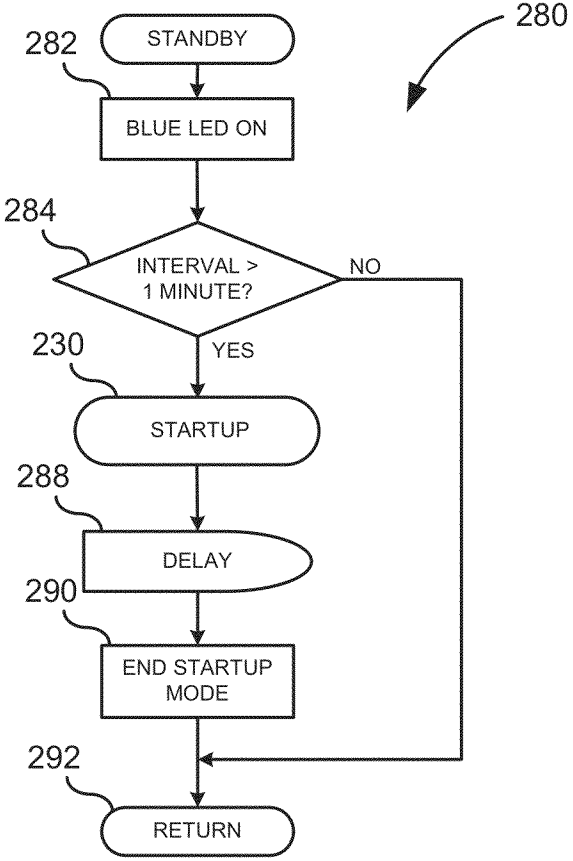
FIG. 7*d* is a flowchart illustrating a representative "Standby" mode of operating a control system in accordance with some preferred embodiments of the invention.
Figure 8:
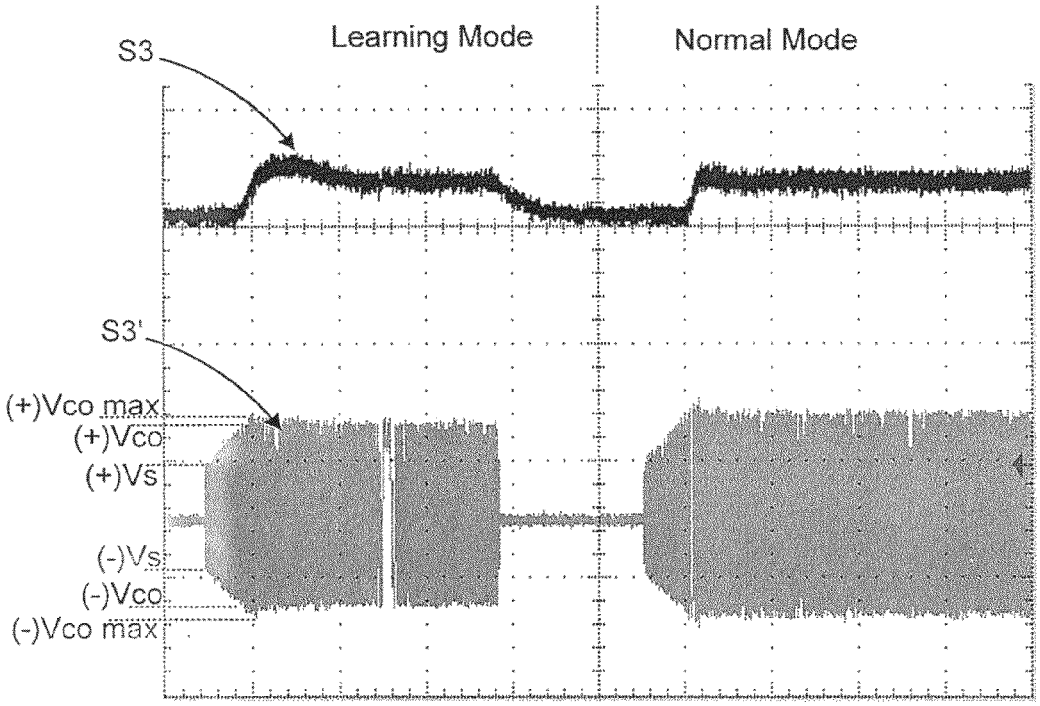
FIG. 8 is an oscilloscope screen-shot comparing a representative corona displacement current signal and a representative high voltage waveform in an inventive ionizer using a nitrogen gas stream during the learning mode of operation (left side) and normal mode of operation (right side)

When sufficient ionizer feedback signal exists or when the start up mode has ended, process 230 passes to box 242 and re-enters power on routine 210 at box 220. Routine 210 then determines whether ionization has begun by monitoring for a sudden rise in the corona feedback signal. If not, the process passes to decision box 224 where the number of retries is tested and onto standby mode 280 if more than 30 retries have occurred. Otherwise the process passes through box 226 where the process is delayed (by a value typically selected between about 2 and 10 seconds) and the start up routine is called once again. Upon returning from start up routine 230, the process passes through decision box 220 and to a Learn Mode 300 of FIG. 7*e* if ionizer conditioning has occurred. If corona feedback is detected, the microprocessor will proceed to the Learn Mode 300 (see FIG. 7*e*). Here the ionizing signal will be ramped up 302 from zero to the point where it once again detects 304 corona feedback. Then, while monitoring the feedback level, the ionizing signal is slightly reduced 306 to the desired quiescent voltage level and the process passes to the Normal Operation Mode 250 (as shown in FIGS. 7*c* and 8).

Normal operation 250 begins at decision box 252 where it is determined whether the standby command is present. If so, the process passes to standby mode 280 and proceeds as described in connection with FIG. 7*d*. Otherwise, process 250 passes to decision box 256 where a high voltage alarm condition is tested. If the hardware is unable to establish and maintain corona feedback signal at the desired level even by driving at 100% voltage output and duty factor, a high voltage alarm condition is set and process 250 passes to box 258 where an alarm LED is illuminated and the high voltage power supply is turned off. Process 250 then passes back to decision box 252 and proceeds. If the alarm condition has not been met, the process passes to box 260 where a low ion output alarm condition is set if the high voltage drive exceeds 95% of maximum. If the low ion output alarm condition is met, normal operation passes to box 262 and a yellow LED is illuminated. The process then passes back to decision box 252 and proceeds as described herein. If the low ion alarm condition is not met, process passes to box 264 where a flow alarm limit condition is set if the vacuum sensor voltage is above the limit, indicating insufficient gas flow. If the alarm condition is met, process 250 passes to box 266 where yellow and blue LEDs are illuminated and the high voltage power supply is turned off. The process, again, passes to decision box 252 and proceeds as described herein. If no flow alarm condition is met, process 250 passes to box 268 and the high voltage applied to the ionizing electrode is adjusted as required for closed loop servo control. Then, the process passes to box 270 where all of the blue, yellow, and red LEDs are turned off. Process 250 then passes back to decision box 252 and proceeds as described herein. When a standby command is received and detected at box 252, the process passes to standby mode 280 and proceeds as described with respect to FIG. 7*d*.

The standby mode 280 begins when the process passes to box 282 and a blue LED is illuminated. If this is the first time through box 284 or more than one minute has passed since the last cycle through box 284, the process passes to box 230 where the start up mode routine proceeds as described with respect to FIG. 7*b*. Upon returning from start up mode 230, the standby process 280 passes to box 288 where a delay (by a value typically selected between about 2 and 10 seconds) is begun and the process moves to box 290 where the end start up mode flag is set. Finally, standby process 280 passes to box 292 where the routine returns to the location from which it was called (in one of FIG. 7*a*, 7*b* or 7*c*). Similarly, if, at box 284 less than one minute has elapsed, standby process 280 passes to box 292 where it returns to the location which called it (in one of FIG. 7*a*, 7*b* or 7*c*).

If the ionizer is put into the Standby state, by an external input or due to an alarm condition, it will preferably remain in that state until the alarm is cleared or the external input changes state. Standby mode may be indicated by a different visual display such as constant illumination of a blue LED.

FIG. 8 is an oscilloscope screen-shot showing that, at the start of the Learn mode 300, the microprocessor-based control system 36"/36''' controls power supply 9" to substantially instantly (2.5 kV/ms) ramp up the ionizing voltage S3' applied to the ionizing electrode from zero up to a voltage amplitude $V_s$ whose value is lower than the corona onset voltage $V_{CO}$. This voltage level may be in the range from about 1 kV to about 3.5 kV. During this time period the corona displacement current S3 is close to zero. After that, the microprocessor-based control system will preferably control power supply 9" to decrease the voltage ramp rate to about 5 kV/ms and gradually raise the ionizing voltage S3' above the corona threshold voltage $V_{CO}$. As the corona signal reaches the preset level, the microprocessor-based control system 36"/36''' will control the power amplifier to keep the ionizing voltage S3' constant during a preset period of time (preferably about 3 seconds). This learning process may be repeated several times (up to 30) during which time the control system 36"/36''' may calculate and record the average corona onset voltage value. If the system fails to complete this learning process, the high voltage alarm may be triggered and the high voltage power supply /9" turned off.

If the learning mode runs successfully, the microprocessor may start the Normal Operation routine (also shown in FIG. 8). In this normal mode 250, the power amplifier 9" applies an ionizing voltage S3' to the ionizing electrode 5 that is close to corona onset voltage and changes in corona displacement current S3 are at minimum. This method of managing corona discharge in a flowing stream of gas, and especially in electropositive/noble gases, provides stable corona current and minimizes emitter damage and particle generation. Similar cycles of learning and operating modes will preferably occur each time the preferred ionizer switches from the Standby mode to the Normal Operation mode.

The preferred embodiment may, optionally, enable the microprocessor-based control system 36"/36'" to monitor the status of the ionizing electrode(s) 5 because ionizing electrodes are known to change their characteristics (and, therefore, require maintenance or replacement) as a result of erosion, debris build up and other corona related processes. According to this optional feature, microprocessor-based control system 36"/36'" may monitor the corona onset/threshold voltage $V_{co}$ during each learning cycle and that value may be compared with preset maximum threshold voltage $V_{CO\ max}$. When $V_{CO}$ becomes close to or equal to $V_{CO\ max}$ microprocessor 36'/36" may initiate a maintenance alarm signal (see FIG. 7*c*).

In the alternative, it is also possible to record in microprocessor memory the original corona onset/threshold voltage of the emitter at time of emitter installation. By comparing the original and current corona onset/thresholds, the degradation rate of electrode 5 can be defined for certain ionizers, certain gases and/or certain environments.

For completeness, FIG. 9 shows an oscilloscope screenshot displaying several cycles of ionizer operation during the Normal Operation mode running a 50% duty cycle. In this mode, the ionizing voltage S4' applied to the ionizing electrode 5 is turned on and off. The corona displacement current then follows accordingly.

While the present invention has been described in connection with what is presently considered to be the most practical and preferred embodiments, it is to be understood that the invention is not limited to the disclosed embodiments, but is intended to encompass the various modifications and equivalent arrangements included within the spirit and scope of the appended claims. With respect to the above description, for example, it is to be realized that the optimum dimensional relationships for the parts of the invention, including variations in size, materials, shape, form, function and manner of operation, assembly and use, are deemed readily apparent to one skilled in the art, and all equivalent relationships to those illustrated in the drawings and described in the specification are intended to be encompassed by the appended claims. Therefore, the foregoing is considered to be an illustrative, not exhaustive, description of the principles of the present invention.

Other than in the operating examples or where otherwise indicated, all numbers or expressions referring to quantities of ingredients, reaction conditions, etc. used in the specification and claims are to be understood as modified in all instances by the term "about." Accordingly, unless indicated to the contrary, the numerical parameters set forth in the following specification and attached claims are approximations that can vary depending upon the desired properties, which the present invention desires to obtain. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical values, however, inherently contain certain errors necessarily resulting from the standard deviation found in their respective testing measurements.

Also, it should be understood that any numerical range recited herein is intended to include all sub-ranges subsumed therein. For example, a range of "1 to 10" is intended to include all sub-ranges between and including the recited minimum value of 1 and the recited maximum value of 10; that is, having a minimum value equal to or greater than 1 and a maximum value of equal to or less than 10. Because the disclosed numerical ranges are continuous, they include every value between the minimum and maximum values. Unless expressly indicated otherwise, the various numerical ranges specified in this application are approximations.

For purposes of the description hereinafter, the terms "upper", "lower", "right", "left", "vertical", "horizontal", "top", "bottom", and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

Various ionizing devices and techniques are described in the following U.S. patents and published patent application, the entire contents of which are hereby incorporated by reference: U.S. Pat. No. 5,847,917, to Suzuki, bearing application Ser. No. 08/539,321, filed on Oct. 4, 1995, issued on Dec. 8, 1998and entitled "Air Ionizing Apparatus And Method"; U.S. Pat. No. 6,563,110, to Leri, bearing application Ser. No. 09/563,776, filed on May 2, 2000, issued on May 13, 2003and entitled "In-Line Gas Ionizer And Method"; and U.S. Publication No. US 2007/0006478, to Kotsuji, bearing application Ser. No. 10/570,085, filed Aug. 24, 2004and published Jan. 11, 2007, and entitled "Ionizer".

We claim:

1. A gas ionization apparatus for converting a non-ionized gas stream that defines a downstream direction into an ionized gas stream, the apparatus comprising:

means for receiving the non-ionized gas stream and for delivering the ionized gas stream to the target;

at least one ionizing electrode for producing charge carriers in the non-ionized gas stream in response to the provision of an ionizing signal having a cycle T with positive and negative portions, wherein the charge carriers comprise clouds of electrons, positive ions and negative ions that convert the non-ionized gas stream into the ionized gas stream, and wherein the electron cloud is produced during a time Tnc of the negative portion of the ionizing signal;

means for monitoring the charge carriers in the ionized gas stream, at least a portion of the means for monitoring being located downstream of the means for producing charge carriers by a distance L, and the time Tnc being less than or equal to a time Te that it takes the electron cloud produced during the time Tnc to move downstream by the distance L;

means for monitoring the non-ionized gas stream; and means, at least partially responsive to the means for monitoring the non-ionized gas stream, for controlling the ionizing signal.

2. A gas ionization apparatus for delivering an ionized gas stream to a charge neutralization target, the apparatus receiving a non-ionized gas stream that defines a downstream direction and comprising:

at least one non-conductive through-channel for receiving the non-ionized gas stream and for delivering the ionized gas stream to the target;

at least one ionizing electrode for producing charge carriers in the non-ionized gas stream in response to the provision of an ionizing signal having a cycle T with positive and negative portions, wherein the charge carriers comprise clouds of electrons, positive ions and negative ions that enter the non-ionized gas stream to form the ionized gas stream;

a power supply for providing the ionizing signal to the ionizing electrode, wherein the electron cloud is produced by the ionizing electrode during a time Tnc of the negative portion of the ionizing signal;

at least one non-ionizing reference electrode downstream of the ionizing electrode and on an exterior of the through-channel, the reference electrode producing a monitor signal responsive to the charge carriers within the ionized gas stream, wherein the electron cloud produced by the ionizing electrode oscillates between the ionizing electrode and the exterior reference electrode whereby the electrons are converted into negative ions;

a sensor for monitoring the the non-ionized gas stream; and a control system communicatively coupled to the power supply and to the sensor to control a variable duty factor of the ionizing signal provided to the ionizing electrode, at least in part, responsive to the monitored non-ionized gas stream.

3. The gas ionization apparatus of claim 2 wherein the non-ionized gas stream is an electropositive gas stream with a flow rate that is between about 5 liters per minute and about 150 liters per minute.

4. The gas ionization apparatus of claim 2 wherein the ionizing signal has a pulse repetition rate that is between about 0.1 and 1000 Hz and a voltage magnitude that is between about 1000 Volts and 20 kiloVolts.

5. The gas ionization apparatus of claim 2 wherein the ionizing signal has an operating magnitude, and the control system adjusts the operating magnitude of ionizing signal to compensate for changes in conditions such as gas composition, gas pressure and temperature.

6. The gas ionization apparatus of claim 2 wherein the ionizing signal has a frequency that is between about 0.05 kiloHertz and about 200 kiloHertz and a duty cycle that is between about one percent and about 100 percent.

7. A method of producing a self-balancing ionized gas stream flowing in a downstream direction, comprising:

establishing a non-ionized gas stream flowing in the downstream direction;

producing charge carriers within the non-ionized gas stream at a first location within the non-ionized gas stream in response to the provision of an ionizing signal having a cycle T with positive and negative portions, wherein the charge carriers comprise clouds of electrons, positive ions and negative ions that convert the non-ionized gas stream into the ionized gas stream, and wherein the electron cloud is produced during a time Tnc of the negative portion of the ionizing signal;

monitoring the charge carriers in the ionized gas stream downstream of the first location by a distance L, wherein the time Tnc is less than a time Te that it takes the electron cloud produced during time Tnc to move downstream by distance L;

monitoring the non-ionized gas stream; and controlling the ionizing signal, at least in part, responsive to the step of monitoring the non-ionized gas stream.

8. The method of claim 7 wherein the step of producing further comprises applying a radio frequency ionizing signal within the non-ionized gas stream to thereby produce charge carriers through corona discharge, the ionizing signal varying in duty factor in accordance with the step of controlling in response to the monitored non-ionized gas stream.

9. The gas ionization apparatus of claim 1 wherein the means monitoring the non-ionized gas stream comprises a gas pressure sensor for monitoring gas pressure within the ionization cell and the means for controlling comprises a control system communicatively linked the gas pressure sensor.

10. The gas ionization apparatus of claim 9 wherein the control system generates an alarm if the monitored gas pressure within the ionization cell is outside predetermined levels.

11. The gas ionization apparatus of claim 1 wherein the means for monitoring the on-ionized gas stream comprises an incoming gas pressure sensor for monitoring gas flow within the ionization cell and the means for controlling comprises a control system communicatively linked the incoming gas pressure sensor.

12. The gas ionization apparatus of claim 1 wherein the means for monitoring the non-ionized gas stream comprises a vacuum sensor for monitoring gas pressure within the ionization cell and the means for controlling comprises a control system communicatively linked the vacuum sensor.

13. The gas ionization apparatus of claim 12 wherein the control system generates an alarm if the monitored vacuum level within the ionization cell is outside predetermined levels.

14. The gas ionization apparatus of claim 1 wherein the means for monitoring the charge carriers comprises at least one reference electrode positioned at one end of the ion drift region and wherein the at least one reference electrode is a conductive ring.

15. The gas ionization apparatus of claim 2 wherein the control system generates an alarm if the monitored gas flow within the ionization cell is outside predetermined levels.

16. The gas ionization apparatus of claim 2 wherein the sensor comprises an incoming gas pressure sensor for monitoring non-ionized gas flow within the ionization cell.

17. The gas ionization apparatus of claim 2 wherein the sensor comprises a vacuum sensor for monitoring non-ionized gas flow within the ionization cell.

18. The gas ionization apparatus of claim 17 wherein the control system generates an alarm if the monitored vacuum level within the ionization cell is outside predetermined levels.

19. The gas ionization apparatus of claim 2 wherein the at least one non-ionizing reference electrode is a conductive ring positioned at one end of the ion drift region.

20. The method of claim 7 wherein the step of monitoring the non-ionized gas stream comprises monitoring the pressure of the non-ionized gas stream and wherein the step of controlling further comprises generating an alarm if the monitored pressure is outside predetermined levels.

21. The method of claim 7 wherein the step of monitoring the non-ionized gas stream comprises monitoring an incoming gas pressure.

22. The method of claim 7 wherein the step of monitoring the non-ionized gas stream comprises monitoring vacuum pressure of the gas stream.

23. The method of claim 22 wherein the step of controlling further comprises generating an alarm if the monitored vacuum pressure is outside predetermined levels.

* * * * *